United States Patent [19]

Borenstein, David E.

[11] Patent Number: 4,639,986

[45] Date of Patent: Feb. 3, 1987

[54] FILAMENT JET ENTANGLER

[75] Inventor: Borenstein, David E., Greenville, S.C.

[73] Assignee: Phillips Petroleum Company, Bartlesville, Okla.

[21] Appl. No.: 249,802

[22] Filed: Apr. 1, 1981

[51] Int. Cl.[4] ..... D02G 1/16; D02J 1/08

[52] U.S. Cl. ..... 28/272; 28/274; 28/276

[58] Field of Search ..... 28/272, 274, 276

[56] References Cited

U.S. PATENT DOCUMENTS

| | | | |
|---|---|---|---|
| 2,985,995 | 5/1961 | Bunting, Jr. et al. . | |
| 3,115,691 | 12/1963 | Bunting, Jr. et al. | 28/274 |
| 3,262,179 | 7/1966 | Sparling . | |
| 3,443,292 | 5/1969 | Davis, Jr. | 28/272 |
| 3,483,691 | 12/1969 | Williams et al. . | |
| 3,730,413 | 5/1973 | McDermott et al. | 28/272 |
| 3,751,775 | 8/1973 | Psaras | 28/274 X |
| 3,828,404 | 8/1974 | Peckinpaugh et al. | 28/276 X |
| 4,164,841 | 8/1979 | Borenstein et al. . | |
| 4,253,299 | 3/1981 | Borenstein et al. . | |

FOREIGN PATENT DOCUMENTS

| | | | |
|---|---|---|---|
| 436196 | 11/1967 | Switzerland | 28/272 |
| 1558091 | 12/1979 | United Kingdom . | |

*Primary Examiner*—Robert R. Mackey

*Attorney, Agent, or Firm*—French and Doescher

[57] ABSTRACT

A filament jet entangler comprising a supporting bracket and a jet insert mounted thereon, the jet insert including a cylindrical yarn confining passage extending therethrough and intersected by a pair of coplanar fluid jet ports whose axes intersect at the cylindrical wall defining the yarn confining passage and define an included angle of about 48°.

59 Claims, 3 Drawing Figures

FILAMENT JET ENTANGLER

The present invention relates generally to the formation of multifilament yarn, and more particularly to apparatus for entangling multifilament yarn.

In the formation of multifilament yarns, such as yarns consisting of filaments of melt-spinnable synthetic organic thermoplastic polymer, e.g. polypropylene, it is often desirable to entangle the filaments to achieve certain aesthetic and/or handling characteristics in the yarn. One technique for performing such entangling is to subject the unentangled multifilament yarn to turbulent fluid, e.g. air or steam, as the yarn is passed linearly through a confining area. Such entanglers are plagued by high acquisition costs, high operating costs, unreliability in retaining the yarn in the confining area and unsatisfactory entangling of the yarn passed therethrough. Accordingly, a fluid jet entangler overcoming these deficiencies of the prior art entangling devices would be highly desirable.

The present invention contemplates a novel filament jet entangler comprising a jet body with a yarn confining passage extending entirely therethrough. A pair of fluid jet ports lying in a common plane intersect the yarn confining passage, with the axes of the fluid jet ports defining an included angle of about 48° therebetween. Fluid passage means communicate with the pair of fluid jet ports for conducting fluid from a source thereof to the fluid jet ports whereby said fluid is directed through the fluid jet ports into the yarn confining passage.

An object of the invention is to provide a filament jet entangler of improved efficiency.

Another object of the invention is to provide a filament jet entangler of improved reliability.

A further object of the invention is to provide a filament jet entangler which provides the desired entanglement in a large variety of multifilament yarns in a broad range of filament numbers, yarn denier and denier per filament.

A still further object of the invention is to provide a filament jet entangler which prevents the expulsion of a multifilament yarn from the yarn confining passage through the stringup slot during the application of pressurized fluid through the fluid jet ports into the yarn confining passage.

Yet another object of the invention is to provide a filament jet entangler which is economical in construction and operation.

Other objects, aspects and advantages of the invention will be evident from the following detailed description and claims when read in conjunction with the accompanying drawings in which:

Figure 1:
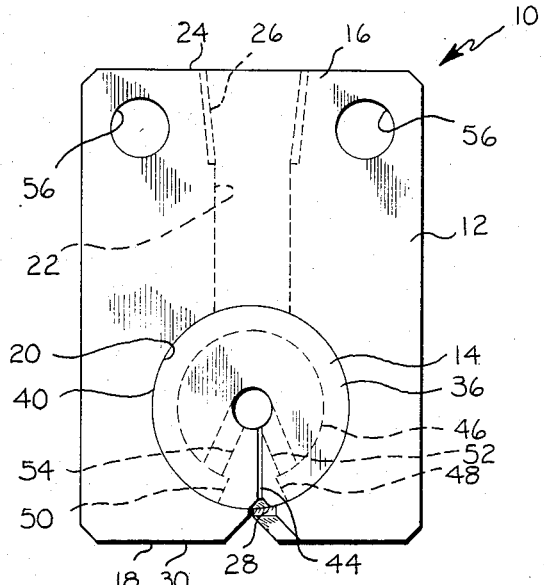
FIG. 1 is a top plan view of a filament jet entangler constructed in accordance with the present invention.
Figure 2:
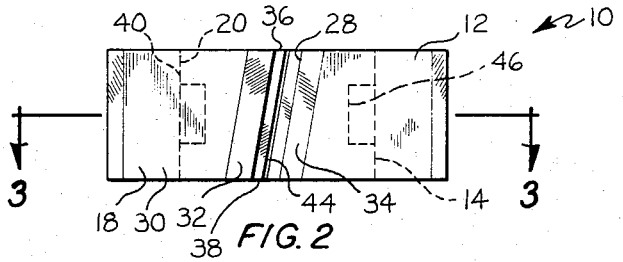
FIG. 2 is a front elevation view of the filament jet entangler of FIG. 1.
Figure 3:
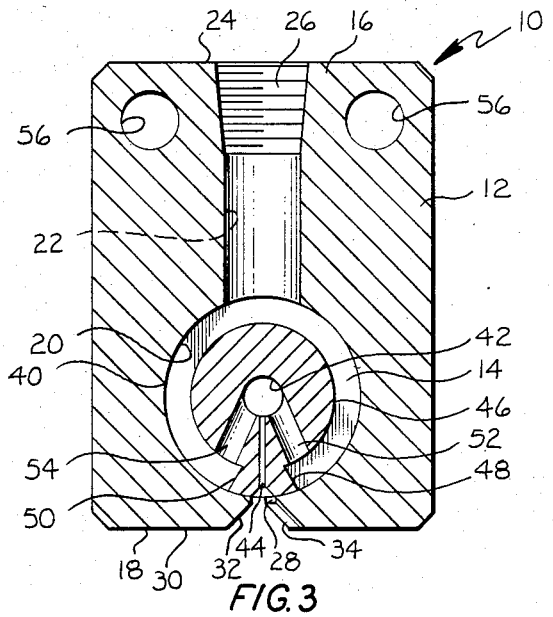
FIG. 3 is a cross sectional view taken along line 3—3 of FIG. 2.

Referring now to FIGS. 1, 2 and 3 of the drawings, a filament jet entangler constructed in accordance with the present invention is illustrated therein and is generally designated by the reference character 10. The entangler 10 may be characterized as a jet body which comprises a supporting bracket 12 and a jet insert 14 mounted in the supporting bracket 12.

The supporting bracket 12 has first and second opposite end portions 16 and 18. A transverse bore 20 is formed in the bracket 12 proximate the second end portion 18 thereof. A fluid passage 22 communicates between a first end face 24 on the first end portion 16 and the substantially cylindrical wall of the bore 20. Internal threads 26 are formed in the fluid passage 22 to provide means for connecting the fluid passage to a suitable conduit connected to a source of pressurized fluid. A stringup slot 28 is formed in the second end portion 18 and communicates between the transverse bore 20 and the second end face 30 of the bracket 12. The slot 28 preferably includes chamfered edges 32 and 34 which intersect the end face 30. The slot 28 is preferably inclined at an angle of approximately 10° to the axis of the bore 20 as viewed in FIG. 2.

The jet insert 14 is provided with upper and lower end faces 36 and 38 and has a substantially cylindrical outer surface 40 extending therebetween. A substantially cylindrical yarn confining passage 42, defined by a substantially cylindrical wall, extends entirely through the jet insert 14 in coaxial alignment with the outer surface 40 and communicates between the upper and lower end faces 36 and 38. The diameter of the outer surface 40 is sized to be closely received within the transverse bore 20 of the supporting bracket 12 to tightly secure the jet insert 14 therein.

The jet insert 14 is further provided with a stringup slot 44 communicating between the outer surface 40 and the passage 42. The slot 44 is preferably inclined at an angle of approximately 10° to the axis of the yarn confining passage 42 and is positioned in registration with the slot 28 of the supporting bracket 12 when the jet insert 14 is properly installed therein. It will be seen that the slot 44 extends the full length of the jet insert 14 communicating between the upper and lower end faces 36 and 38 thereof.

An interrupted circumferential groove 46 is formed in the outer surface 40 of the jet insert 14, intermediate the upper and lower end faces 36 and 38, with the opposite ends 48 and 50 terminating respectively proximate the slot 44. A pair of fluid jet ports or nozzles 52 and 54 each communicate between the groove 46 and the yarn confining passage 42. The ports 52 and 54 are preferably cylindrically shaped and aligned such that their respective axes intersect the cylindrical wall defining the yarn confining passage 42 on the surface thereof diametrically opposite the slot 44. Further, it is preferred that the axes of the ports 52 and 54 lie in a common plane aligned perpendicular or normal to the axis of the passage 42. It is further preferred that the common plane of the ports 52 and 54 intersect the passage 42 equidistant between the opposite end faces 36 and 38 of the jet insert, thereby bisecting the cylindrical yarn confining passage 42. The angle between the coplanar axes of the jet ports 52 and 54 define an included angle of about 48°, and preferably exactly 48°.

The diameters of the yarn confining passage 42 and the jet ports 52 and 54 are preferably selected such that the cross sectional area of the yarn confining passage is in the range from about 3.2 to about 3.6 times the cross sectional area of each fluid jet port or in the range from about 1.6 to about 1.8 times the total cross sectional area of the two fluid jet ports 52 and 54. In a presently preferred embodiment, the yarn confining passage 42 has a diameter of about 0.172 inch (0.467 cm), and more preferably 0.172 inch (0.467 cm), and each of the fluid jet ports 52 and 54 has a diameter in the range from about 0.091 inch (0.231 cm) to about 0.096 inch (0.244 cm), and more preferably 0.096 inch (0.244 cm). The previously mentioned size relationships, and the more specifically recited diameters of the passage 42 and jet ports 52 and 54 have been found to provide optimum entanglement of filaments passing through the filament jet entangler 10.

It should be understood that the fluid passage 22 in the supporting bracket 12 communicates with the interrupted circumferential groove 46 in the jet insert 14 to provide a suitable conduit through the filament jet entangler 10 from the source of pressurized fluid to the yarn filaments passing through the yarn confining passage 42. The stringup slots 28 and 44 in the supporting bracket and jet insert provide convenient means for initially stringing filaments in the filament jet entangler 10. It is presently preferred that the yarn confining passage 42 have a diameter about ten times the width of the slot 44. In a preferred embodiment, the minimum width of the slot 44 is approximately 0.017 inch (0.43 mm). The supporting bracket 12 is preferably provided with means for securely mounting the filament jet entangler 10 to a supporting structure, suitable means being a pair of bolt holes 56 formed in the first end portion 16 of the supporting bracket 12.

While any suitable fluid pressure can be employed with filament jet entangler 10, which will provide the desired entanglement, it has been found that a source of pressurized air in the range from about 60 psig (413 kPa) to about 75 psig (517 kPa) provides good results when entangling 1100 denier/63 filament yarn, 1800 denier/63 filament yarn and 2600 denier/126 filament yarn. Similar good results were obtained with the filament jet entangler 10 when operated with pressurized air in the above-mentioned range for 4 and 6 denier per filament, 1800 denier uncrimped yarn, and for 6 denier per filament, 420 denier false twisted yarn.

Reasonable variations and modifications which will be apparent to those skilled in the art can be made in this invention without departing from the spirit and scope thereof as defined in the following claims.

I claim:

1. A filament entangler comprising:

a jet body;

a yarn confining passage extending entirely through said jet body;

a pair of fluid jet ports in said jet body disposed adjacent to and on opposite sides of said yarn confining passage, said ports communicating in fluid flow relation with said passage, said ports further each having a longitudinal axis, said longitudinal axes lying in a common plane intersecting the axis of said generally cylindrical yarn confining passage and defining an included angle of about 48° therebetween; and fluid passage means communicating with said pair of fluid jet ports for conducting fluid from a source thereof to said fluid jet ports whereby said fluid is directed through said fluid jet ports into said yarn confining passage.

2. A filament jet entangler in accordance with claim 1 characterized further to include a slot in said body communicating between said passage and the exterior of said body, said slot extending the full length of said passage.

3. A filament jet entangler in accordance with claim 2 wherein the slot in said body is inclined at an angle to the axis of said yarn confining passage.

4. A filament jet entangler in accordance with claim 3 wherein the angle is about 10°.

5. A filament jet entangler in accordance with claim 1 wherein the common plane of the axes of said fluid jet ports is perpendicular to the axis of said yarn confining passage.

6. A filament jet entangler in accordance with claim 1 or claim 5 wherein the common plane of the axes of said pair of said fluid jet ports bisects the yarn confining passage.

7. A filament jet entangler in accordance with claim 1 wherein the cross sectional area of said yarn confining passage is in the range from about 3.2 to about 3.6 times the cross sectional area of a fluid jet port.

8. A filament jet entangler in accordance with claim 1 wherein the cross sectional area of said yarn confining passage is about 3.2 times the cross sectional area of each fluid jet port.

9. A filament jet entangler in accordance with claim 1 wherein the cross sectional area of said yarn confining passage is in the range from about 1.6 to about 1.8 times the total cross sectional area of all the fluid jet ports.

10. A filament jet entangler in accordance with claim 9 wherein the diameter of said yarn confining passage is about 0.172 inch (0.467 cm).

11. A filament jet entangler in accordance with claim 10 wherein each fluid jet port is generally cylindrically shaped and has a diameter in the range from about 0.091 inch (0.231 cm) to about 0.096 inch (0.244 cm).

12. A filament jet entangler in accordance with claim 1 or claim 10 wherein the ratio of length to diameter of said yarn confining passage is about 3.26:1.

13. A filament jet entangler in accordance with claim 1 wherein the cross sectional area of said yarn confining passage is about 1.6 times the total cross sectional area of all the fluid jet ports.

14. A filament jet entangler comprising:

a jet body;

a yarn confining passage extending entirely through said jet body, said passage being defined by a generally cylindrical wall having a longitudinal axis;

a pair of fluid jet ports in said jet body having longitudinal axes lying in a common plane and defining an included angle of about 48° therebetween, said fluid jet ports being in fluid flow communication with said yarn confining passage with the axes of said jet ports intersecting at a point on the cylindrical wall of said yarn confining passage; and fluid passage means communicating between said pair of fluid jet ports and a source of fluid for conducting fluid from said source to said fluid jet ports whereby said fluid is directed through said fluid jet ports into said yarn confining passage.

15. A filament jet entangler in accordance with claim 14 wherein the common plane of the axes of said pair of fluid jet ports is perpendicular to the longitudinal axis of said yarn confining passage.

16. A filament jet entangler in accordance with claim 14 or claim 15 wherein the common plane of said axes of said pair of fluid jet ports bisects the yarn confining passage.

17. A filament jet entangler in accordance with claim 14 wherein the cross sectional area of said yarn confining passage is in the range from about 3.2 to about 3.6 times the cross sectional area of a fluid jet port.

18. A filament jet entangler in accordance with claim 14 wherein the cross sectional area of said yarn confining passage is in the range from about 1.6 to about 1.8 times the total cross sectional area of all the fluid jet ports.

19. A filament jet entangler in accordance with claim 18 wherein the diameter of said yarn confining passage is about 0.172 inch (0.467 cm).

20. A filament jet entangler in accordance with claim 14 or claim 19 wherein the ratio of length to diameter of said yarn confining passage is about 3.26:1.

21. A filament jet entangler in accordance with claim 14 wherein each fluid jet port is cylindrically shaped and has a diameter in the range from about 0.091 inch (0.231 cm) to about 0.096 inch (0.244 cm).

22. A filament jet entangler comprising:

a supporting bracket having first and second end portions;

a fluid passage in said bracket communicating with the first end portion there of and extending toward the second end portion;

a transverse bore in said bracket communicating with said fluid passage;

a slot in said bracket communicating between the second end portion thereof and said transverse bore, said slot extending the full length of said transverse bore;

a jet insert having opposite ends, a substantially cylindrical outer surface and a yarn confining passage extending the full length of said jet insert and defined by a substantially cylindrical wall in parallel alignment with the substantially cylindrical outer surface, the diameter of said outer surface being sized to be closely received within said transverse bore of said supporting bracket;

a slot in said jet insert communicating between the outer surface thereof and the yarn confining passage therethrough, said slot extending the full length of said yarn confining passage;

an interrupted circumferential groove formed in the outer surface of said jet insert, the opposite ends of said groove terminating respectively proximate the slot in said jet insert;

a pair of fluid jet ports in said jet insert having longitudinal axes lying in a common plane and defining an included angle of about 48° therebetween and intersecting at a point on the substantially cylindrical wall of said yarn confining passage opposite the slot in said jet insert; and said jet insert being positioned within the transverse bore of said supporting bracket with said interrupted circumferential groove in registration with the fluid passage of said supporting bracket and with the slot in said jet insert in registration with the slot in said supporting bracket.

23. A jet entangler in accordance with claim 22 wherein the common plane of said axes of said pair of fluid jet ports is perpendicular to the axis of the substantially cylindrical wall defining the yarn confining passage.

24. A jet entangler in accordance with claim 22 or claim 23 wherein the common plane of the axes of said pair of fluid jet ports bisects the yarn confining passage.

25. A jet entangler in accordance with claim 22 wherein the cross sectional area of said yarn confining passage is in the range from about 3.2 to about 3.6 times the cross sectional area of a fluid jet port.

26. A jet entangler in accordance with claim 22 wherein the cross sectional area of said yarn confining passage is in the range from about 1.6 to about 1.8 times the total cross sectional area of all the fluid jet ports.

27. A jet entangler in accordance with claim 26 wherein the diameter of said yarn confining passage is about 0.172 inch (0.467 cm).

28. A jet entangler in accordance with claim 26 or claim 27 wherein each fluid jet port is generally cylindrically shaped and has a diameter in the range from about 0.091 inch (0.231 cm) to about 0.096 inch (0.244 cm).

29. A jet entangler in accordance with claim 22 or claim 27 wherein the ratio of length to diameter of said yarn confining passage is about 3.26:1.

30. A jet entangler in accordance with claim 22 or claim 27 wherein the diameter of said yarn confining passage is about ten times the width of the slot in said jet insert.

31. A jet entangler in accordance with claim 30 wherein the slot in said jet insert is inclined at an angle of about 10° to the axis of said yarn confining passage.

32. A filament entangler comprising:

a jet body a yarn confining passage extending entirely through said jet body;

a pair of fluid jet ports in said jet body disposed adjacent to and on opposite sides of said yarn confining passage, said ports communicating in fluid flow relation with said passage, said ports further each having a longitudinal axis, said longitudinal axes lying in a common plane intersecting the axis of said generally cylindrical yarn confining passage and defining an acute included angle therebetween, and the cross sectional area of said yarn confining passage being in the range from about 3.2 to about 3.6 times the cross sectional area of a fluid jet port; and fluid passage means communicating with said pair of fluid jet ports for conducting fluid from a source thereof to said fluid jet ports whereby said fluid is directed through said fluid jet ports into said yarn confining passage.

33. A filament jet entangler in accordance with claim 32 characterized further to include a slot in said body communicating between said passage and the exterior of said body, said slot extending the full length of said passage.

34. A filament jet entangler in accordance with claim 33 wherein the slot in said body is inclined at an angle to the axis of said yarn confining passage.

35. A filament jet entangler in accordance with claim 34 wherein the angle is about 10°.

36. A filament jet entangler in accordance with claim 32 wherein the common plane of the axes of said fluid jet ports is perpendicular to the axis of said yarn confining passage.

37. A filament jet entangler in accordance with claim 32 or claim 36 wherein the common plane of the axes of said pair of said fluid jet ports bisects the yarn confining passage.

38. A filament jet entangler in accordance with claim 32 wherein the cross sectional area of said yarn confining passage is about 3.2 times the cross sectional area of each fluid jet port.

39. A filament jet entangler in accordance with claim 32 wherein the cross sectional area of said yarn confining passage is in the range from about 1.6 to about 1.8 times the total cross sectional area of all the fluid jet ports.

40. A filament jet entangler in accordance with claim 39 wherein the diameter of said yarn confining passage is about 0.172 inch (0.467 cm).

41. A filament jet entangler in accordance with claim 40 wherein each fluid jet port is generally cylindrically shaped and has a diameter in the range from about 0.091 inch (0.231 cm) to about 0.096 inch (0.244 cm).

42. A filament jet entangler in accordance with claim 32 or claim 40 wherein the ratio of length to diameter of said yarn confining passage is about 3.26:1.

43. A filament jet entangler in accordance with claim 32 wherein the cross sectional area of said yarn confining passage is about 1.6 times the total cross sectional area of all the fluid jet ports.

44. A filament jet entangler comprising:

a jet body;

a yarn confining passage extending entirely through said jet body, said passage being defined by a generally cylindrical wall having a longitudinal axis;

a pair of fluid jet ports in said jet body having longitudinal axes lying in a common plane and defining an included acute angle therebetween, said fluid jet ports being in fluid flow communication with said yarn confining passage with the axes of said jet ports intersecting at a point on the cylindrical wall of said yarn confining passage, and the cross sectional area of said yarn confining passage being in the range from about 3.2 to about 3.6 times the cross sectional area of a fluid jet port; and fluid passage means communicating between said pair of fluid jet ports and a source of fluid for conducting fluid from said source to said fluid jet ports whereby said fluid is directed through said fluid jet ports into said yarn confining passage.

45. A filament jet entangler in accordance with claim 44 wherein the common plane of the axes of said pair of fluid jet ports is perpendicular to the longitudinal axis of said yarn confining passage.

46. A filament jet entangler in accordance with claim 44 or claim 45 wherein the common plane of said axes of said pair of fluid jet ports bisects the yarn confining passage.

47. A filament jet entangler in accordance with claim 44 wherein the cross sectional area of said yarn confining passage is in the range from about 1.6 to about 1.8 times the total cross sectional area of all the fluid jet ports.

48. A filament jet entangler in accordance with claim 47 wherein the diameter of said yarn confining passage is about 0.172 inch (0.467 cm).

49. A filament jet entangler in accordance with claim 44 or claim 48 wherein the ratio of length to diameter of said yarn confining passage is about 3.26:1.

50. A filament jet entangler in accordance with claim 44 wherein each fluid jet port is cylindrically shaped and has a diameter in the range from about 0.091 inch (0.231 cm) to about 0.096 inch (0.244 cm).

51. A filament jet entangler comprising:

a supporting bracket having first and second end portions;

a fluid passage in said bracket communicating with the first end portion there of and extending toward the second end portion;

a transverse bore in said bracket communicating with said fluid passage;

a slot in said bracket communicating between the second end portion thereof and said transverse bore, said slot extending the full length of said transverse bore;

a jet insert having opposite ends, a substantially cylindrical outer surface and a yarn confining passage extending the full length of said jet insert and defined by a substantially cylindrical wall in parallel alignment with the substantially cylindrical outer surface, the diameter of said outer surface being sized to be closely received within said transverse bore of said supporting bracket;

a slot in said jet insert communicating between the outer surface thereof and the yarn confining passage therethrough, said alot extending the full length of said yarn confining passage;

an interrupted circumferential groove formed in the outer surface of said jet insert, the opposite ends of said groove terminating respectively proximate the slot in said jet insert;

a pair of fluid jet ports in said jet insert having longitudinal axes laying in a common plane and defining an included acute angle therebetween and intersecting at a point on the substantially cylindrical wall of said yarn confining passage opposite the slot in said jet insert, and the cross sectional area of said yarn confining passage being in the range from about 3.2 to about 3.6 times the cross sectional area of a fluid jet port; and said jet insert being positioned within the transverse bore of said supporting bracket with said interrupted circumferential groove in registration with the fluid passage of said supporting bracket and with the slot in said jet insert in registration with the slot in said supporting bracket.

52. A jet entangler in accordance with claim 51 wherein the common plane of said axes of said pair of fluid jet ports is perpendicular to the axis of the substantially cylindrical wall defining the yarn confining passage.

53. A jet entangler in accordance with claim 51 or claim 52 wherein the common plane of the axes of said pair of fluid jet ports bisects the yarn confining passage.

54. A jet entangler in accordance with claim 51 wherein the cross sectional area of said yarn confining passage is in the range from about 1.6 to about 1.8 times the total cross sectional area of all the fluid jet ports.

55. A jet entangler in accordance with claim 54 wherein the diameter of said yarn confining passage is about 0.172 inch (0.467 cm).

56. A jet entangler in accordance with claim 54 or claim 55 wherein each fluid jet port is generally cylindrically shaped and has a diameter in the range from about 0.091 inch (0.231 cm) to about 0.096 inch (0.244 cm).

57. A jet entangler in accordance with claim 51 or claim 55 wherein the ratio of length to diameter of said yarn confining passage is about 3.26:1.

58. A jet entangler in accordance with claim 51 or claim 55 wherein the diameter of said yarn confining passage is about ten times the width of the slot in said jet insert.

59. A jet entangler in accordance with claim 58 wherein the slot in said jet insert is inclined at an angle of about 10° to the axis of said yarn confining passage.

* * * * *